US011069205B1

(12) United States Patent
Henley

(10) Patent No.: US 11,069,205 B1
(45) Date of Patent: Jul. 20, 2021

(54) OCCUPIED STRUCTURE RESCUE SYSTEM AND METHOD

(71) Applicant: Stephen D. Henley, Arlington, TX (US)

(72) Inventor: Stephen D. Henley, Arlington, TX (US)

( * ) Notice: Subject to any disclaimer, the term of this patent is extended or adjusted under 35 U.S.C. 154(b) by 0 days.

(21) Appl. No.: 17/081,104

(22) Filed: Oct. 27, 2020

(51) Int. Cl.

| | |
|---|---|
| ***G08B 5/38*** | (2006.01) |
| ***G08B 25/00*** | (2006.01) |
| ***G08B 25/10*** | (2006.01) |
| ***G08B 21/02*** | (2006.01) |

(52) U.S. Cl.
CPC ..... *G08B 5/38* (2013.01); *G08B 21/02* (2013.01); *G08B 25/001* (2013.01); *G08B 25/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 2003/0016129 | A1* | 1/2003 | Menard | G08B 25/009 340/531 |
| 2004/0027244 | A9* | 2/2004 | Menard | G08B 1/08 340/573.1 |
| 2005/0057342 | A1* | 3/2005 | Haynes | G08B 25/002 340/291 |

* cited by examiner

*Primary Examiner* — Travis R Hunnings
(74) *Attorney, Agent, or Firm* — Leavitt Eldredge Law Firm

(57) ABSTRACT

An occupied structure rescue system includes an activation device to be mounted on an interior surface of a building, the activation device having a switch; a light in communication with the activation device to be activated via the switch, the light to mount on an exterior surface of the building; a remote device to wirelessly communicate with the light to activate the light; and a power supply to power the light, the power supply having a predetermined value of stored power; activation of the light causes the light to flash until the predetermined value of stored power is used or until the light is deactivated via the remote device.

7 Claims, 5 Drawing Sheets

OCCUPIED STRUCTURE RESCUE SYSTEM AND METHOD

BACKGROUND

1. Field of the Invention

The present invention relates generally to building rescue systems and methods, and more specifically, to an occupied structure rescue system for providing fast and accurate alerts regarding the building occupants for an improved rescue method.

2. Description of Related Art

Rescue systems and methods are well known in the art. For example, FIG. 1 depicts a flowchart 101 of a conventional rescue method, wherein a person notices a dangerous situation, such as area flooding, and calls emergency personnel, as shown with box 103. The emergency personnel arrive at the scene and begin searching for occupants of the building in an attempt to rescue as many people as possible, as shown with boxes 105, 107.

One of the problems commonly associated with method 101 is limited information. For example, the emergency personnel typically do not know the locations of persons needing to be rescued within or in proximity to the building or even if the building is occupied. These limitations are compounded by conditions wherein visibility is limited.

Accordingly, although great strides have been made in the area of rescue systems and methods, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
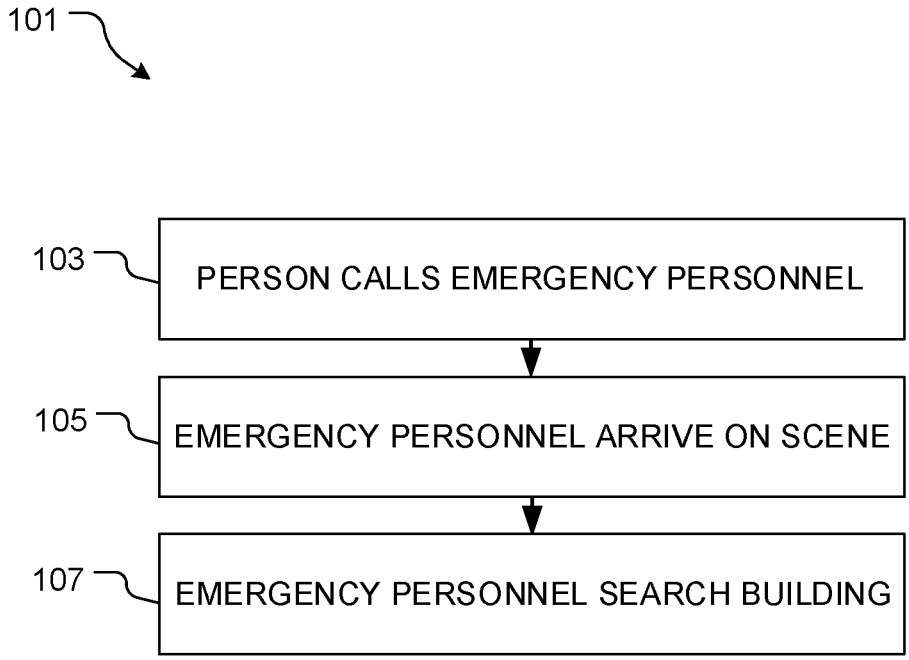
FIG. 1 (Prior Art)
FIG. 1 is a flowchart of a common rescue method.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional rescue systems and methods. Specifically, the present invention provides an improved means of alerting third parties as to the locations of persons within or in proximity to a building/structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
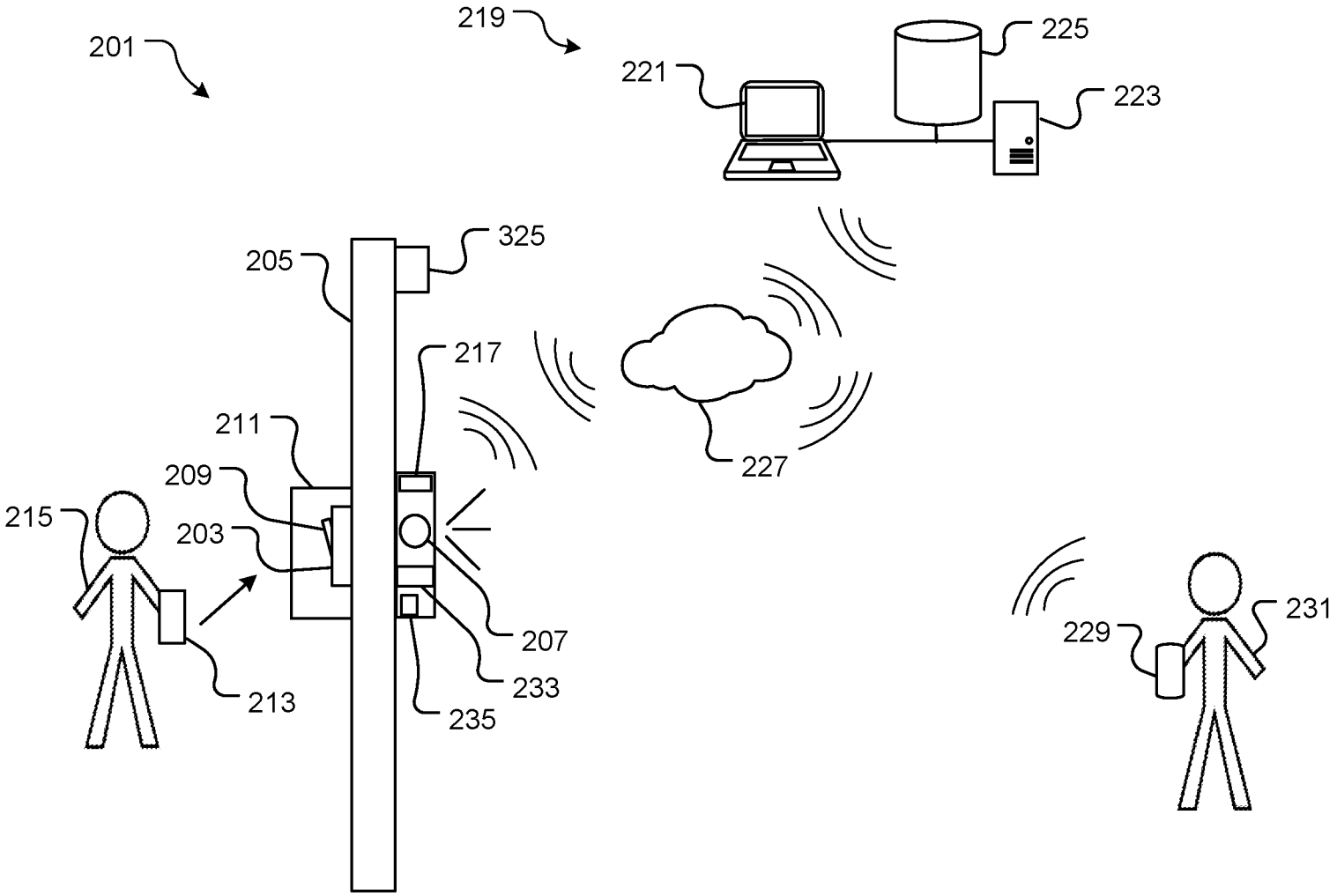
FIG. 2 is a simplified schematic of an occupied structure rescue system in accordance with a preferred embodiment of the present application.

Referring now to the drawings wherein like reference characters identify corresponding or similar elements throughout the several views, FIG. 2 depicts a simplified schematic of an occupied structure rescue system 201 in accordance with a preferred embodiment of the present application. It will be appreciated that system 201 overcomes one or more of the above-listed problems commonly associated with conventional rescue systems and methods.

In the contemplated embodiment, system 201 includes an activation device 203 mounted on the interior or exterior of a building 205, the activation device being in communication with a light 207 mounted in rooms or on an exterior of a building or room 205. In one embodiment, device 203 includes a switch 209 configured to activate light 207, however it is contemplated that device 203 could include a plurality of buttons, knobs, and the like. It should be appreciated that device 203 and light 207 can be in wired communication or can communicate wirelessly through radio waves, WIFI, Bluetooth, and the like. In some embodiments, device 203 is housed in a secure, water proof and fire-resistant housing 211 thereby protecting device 203 from damage.

System 201 can further include one or more remotes 213 configured to communicate with light 207 and/or activation device 203, thereby providing additional means to activate and deactivate light 207.

During use, a person 215 inside, on top of, or in proximity to building 205 activates light 207 either through use of activation device 203 or remote 213, wherein the activation causes light 207 to flash, strobe, or otherwise provide a notice to the exterior of building. This thereby provides emergency personnel (or others) with a notice that the building is occupied. It should be appreciated that a plurality of lights and activation devices can be incorporated into the building, thereby providing a means for alerting as to the location of the occupants. In these embodiments, the lights would alert that a room, floor, or other designated location has occupants remaining to be rescued.

System 201 can further include a computing device 217 associated with light 207, thereby providing a means to wirelessly receive commands and send data to a central monitoring location 219 having one or more of a computer 221, server 223, and database 225. This feature allows for the sending of data such as location via a wireless network 227 to the monitoring location 219, wherein information, e.g. location and number of occupants, can then be shared to emergency personnel. In addition, one or more mobile computing devices 229 such as mobile phones, can be used in system 201 to further allow for transmitting of information among emergency personnel 231.

In the preferred embodiment, a power source 233 is incorporated into system 201, wherein power source 233 includes a predetermined value of power to supply to light 207. During use, the power supply provides a means for the light to flash/strobe until the light is deactivated manually, or for a predetermined time. The power source can incorporate hard wiring to the building, batteries, solar charging, and the like.

In some embodiments a code 235 is included in system 201, wherein code 235 can be scanned by the one or more mobile computing devices 229. The code can be scanned to send determined data to the server to confirm authenticity of the system ownership and further forward this information onto necessary destinations. In some embodiments, the one or more mobile devices can further be used to activate and deactivate light 207.

It should be appreciated that one of the unique features believed characteristic of the present application is the use activation device in connection with an external light, wherein activation of the internal device commands the light to strobe/flash for a predetermined time as based on the power reserve in the power source. It should be understood that the power source is connected to the light and can ensure that the light is powered regardless of the external conditions.

Figure 3:
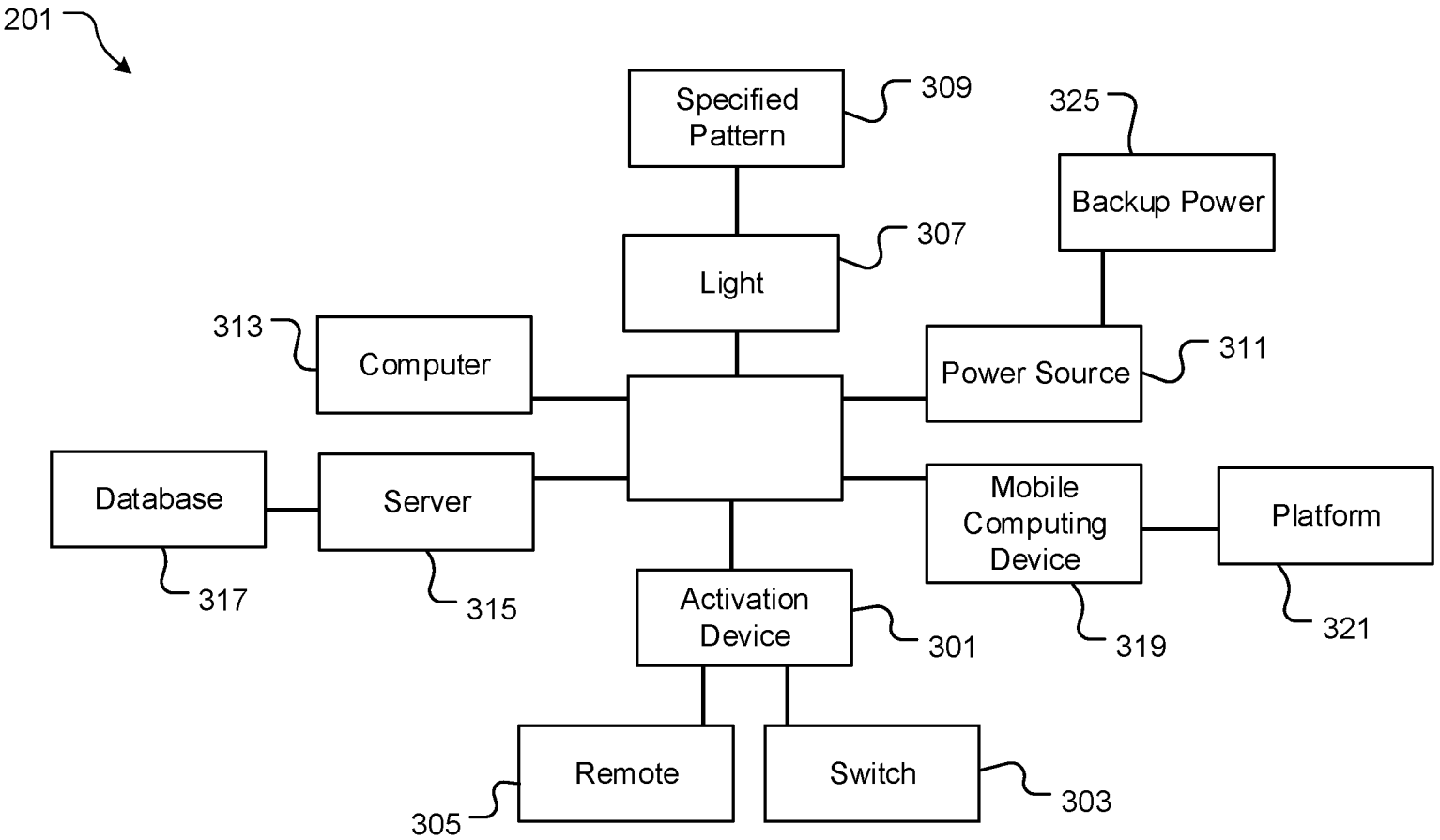
FIG. 3 is a simplified schematic of the features of the system of FIG. 2.

In FIG. 3, a simplified schematic further demonstrates the features of system 201. The primary components of system 201 include an activation device 301, being one or more of a switch 303 to be mounted on the interior of a building and a remote 305. The activation device is in direct communication with a light 307, wherein the light is mounted on the exterior of the building and can be pre-programmed to strobe and/or flash. It is contemplated that the light can further be programmed to flash in a specified pattern 309, such as an SOS pattern.

System 201 further includes a power source 311 configured to power the light. The power source 311 includes a power reserve, wherein the reserve provides a means to power the light for a predetermined time, thereby ensuring extended activation time for the light source. In some embodiments, a backup power source 325 can be incorporated into system 201.

System 201 further includes one or more computing devices 313 configured to provide a means to control the system, receive commands, and transmit data for recording and processing. In some embodiments, a server 315 is provided to collect data 317 and facilitate communication with various parties, such as emergency personnel, and internet platforms.

Lastly, system 201 can include a plurality of mobile computing devices 319 such as mobile phones, wherein the computing devices 319 provide access to a platform 321. Mobile computing devices 319 can receive information from the server 315 and can further be programmed to send commands to activate and deactivate the system.

Figure 4:
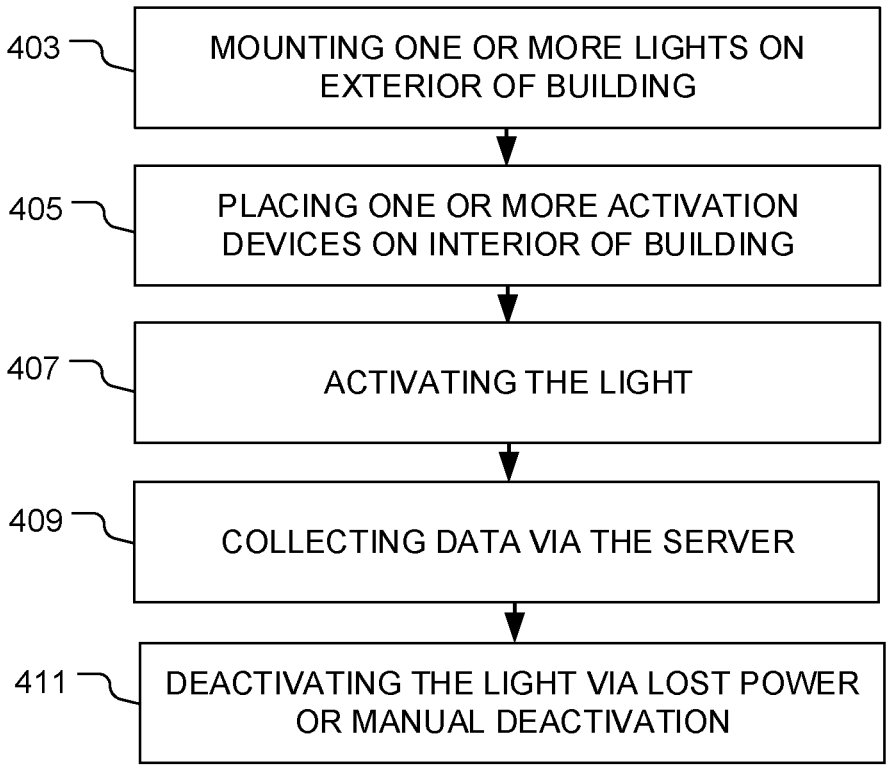
FIG. 4 is a flowchart of the method of the system of FIG. 2.

In FIG. 4, a flowchart 401 depicts a method of use of system 201. During use, one or more lights are mounted on the exterior of a building, as shown with box 403. It is contemplated that 403 could include a plurality of lights mounted in the interior. One or more activation devices are provided, being in communication with the one or more lights, as shown with box 405. People on the inside of a building can then activate the light via the mounted activation devices or remotes, as shown with box 407. The light then strobes or flashes to indicate that the building is occupied. In some embodiments, data is transmitted to the server for collection and transmittal to emergency personnel, as shown with box 409. The light strobes/flashes until the power supply is used or until the light is manually deactivated, as shown with box 411.

Figure 5:
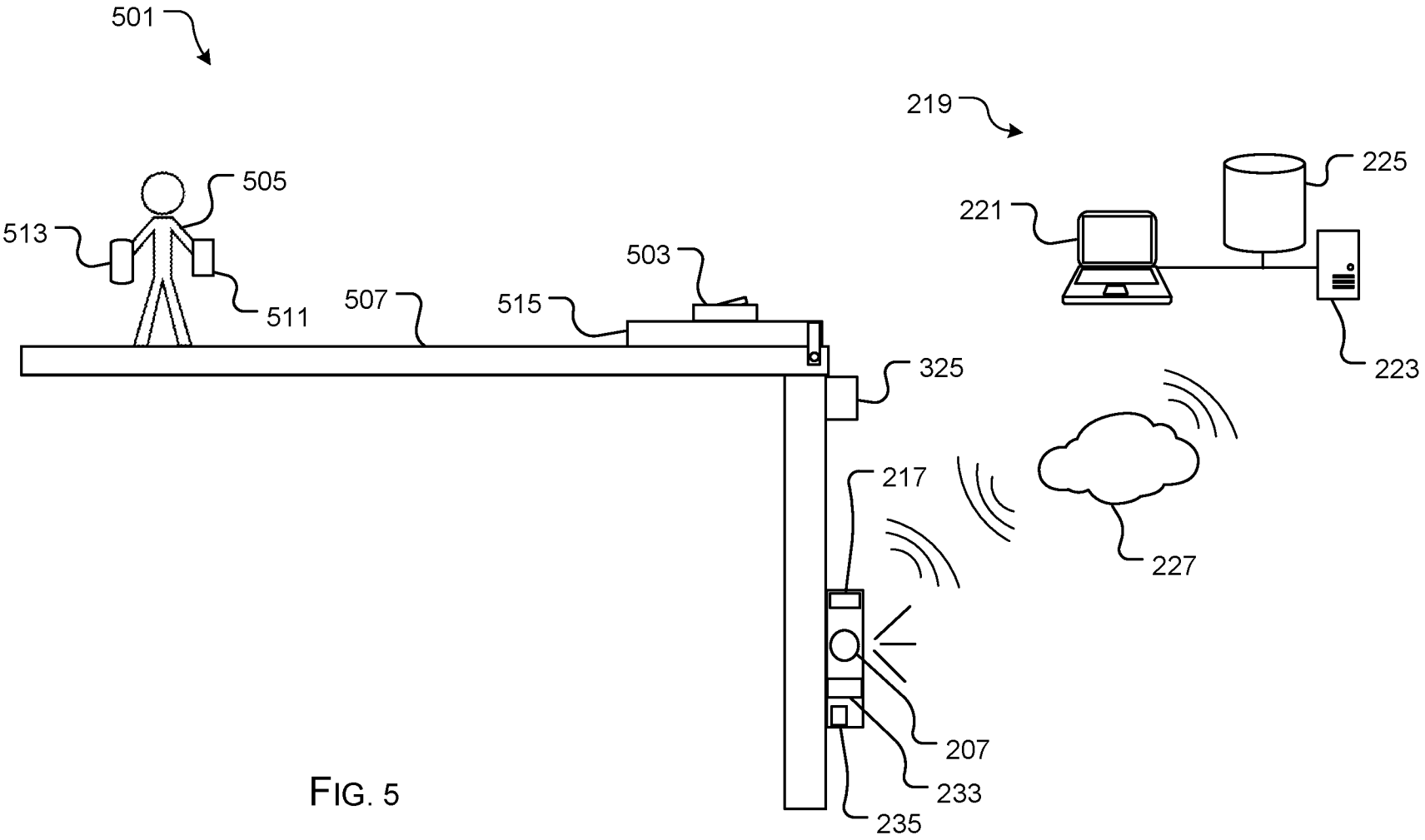
FIG. 5 is a simplified schematic of an alternative embodiment of an occupied structure rescue system in accordance with the present application.

In FIG. 5, a simplified schematic of an alternative embodiment of an occupied structure rescue system 501 is shown, having many of the same features discussed herein, including light 207 with a computing device 217 and a power source 233 and a code 235, wherein computing device 217 is configured to wirelessly communicate through network 227 to monitoring location 219. System 501 further includes an exterior switch 503 accessible by a user 505 on an exterior of a building, such as on a roof 507. User can activate light 207 via switch 503, a remote 511, or a phone 513. In some embodiments, an escape hatch 515 can be included for the user to escape roof 507.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An occupied structure rescue system, comprising:

an activation device configured to be mounted on or within a building, the activation device having a switch;

a light in communication with the activation device and configured to be activated via the switch, the light being configured to mount on an exterior surface of the building;

a remote device configured to wirelessly communicate with the light to activate the light; and a power supply configured to power the light, the power supply having a predetermined value of stored power;

wherein activation of the light causes the light to flash until the predetermined value of stored power is used or until the light is deactivated via the remote device.

2. The system of claim 1, further comprising:

a housing composed of a fire retardant and water-resistant material and configured to house the activation device.

3. The system of claim 1, further comprising:

a computing device associated with the light and configured to wirelessly communicate with a central server, wherein the computing device transmits data to the server.

4. The system of claim 3, further comprising:

one or more mobile computing devices providing access to a platform configured to wirelessly communicate with the computing device, wherein the one or more mobile computing devices are configured to activate and deactivate the light.

5. A method of providing information regarding an occupied building in an emergency situation, the method comprising:

mounting an activation device on or within a building, the activation device having a switch;

mounting a light on an exterior or interior of the building, wherein the light is in direct communication with the activation device;

indicating that the building is occupied by operation of the switch, wherein a command is transmitted to the light via the activation device, the command indicating that the building is occupied and commanding the light to start flashing; and providing a remote device configured to activate and deactivate the light;

wherein the light flashes until a predetermined value of power stored in a power source is used or until the light receives a command to deactivate.

6. The method of claim 5, further comprising:

transmitting data to a central server via a computing device associated with the light.

7. The method of claim 5, further comprising: programming the light to strobe in a specified pattern.

* * * * *